US008519942B2

(12) United States Patent
Kao

(10) Patent No.: US 8,519,942 B2
(45) Date of Patent: Aug. 27, 2013

(54) DISPLAY DEVICE AND BACKLIGHT BRIGHTNESS CONTROL METHOD THEREOF

(75) Inventor: Hsu-Pin Kao, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 177 days.

(21) Appl. No.: 13/111,985

(22) Filed: May 20, 2011

(65) Prior Publication Data

US 2012/0112993 A1 May 10, 2012

(30) Foreign Application Priority Data

Nov. 9, 2010 (TW) ..... 99138452 A

(51) Int. Cl.
*G09G 3/36* (2006.01)

(52) U.S. Cl.
USPC ..... 345/102; 345/690

(58) Field of Classification Search
USPC ..... 345/102, 690
See application file for complete search history.

(56) References Cited

U.S. PATENT DOCUMENTS

2007/0097069 A1* 5/2007 Kurokawa et al. ..... 345/102
2008/0143756 A1* 6/2008 Yamamoto et al. ..... 345/690
2011/0090265 A1* 4/2011 Muroi et al. ..... 345/690

* cited by examiner

*Primary Examiner* — William Boddie
*Assistant Examiner* — Leonid Shapiro
(74) *Attorney, Agent, or Firm* — Altis Law Group, Inc.

(57) ABSTRACT

A display device includes a display module for displaying an image, a backlight module for providing backlight to the display module, a memory, a brightness computing module, a retrieving module, and a backlight adjusting module. The memory is used for storing a relationship between an image brightness and a backlight adjusting coefficient. The brightness computing module is used for computing the brightness of a current display image. The retrieving module is used for retrieving a backlight adjusting coefficient corresponding to the current display image from the memory according to the current display image brightness. The backlight adjusting module is used for adjusting backlight brightness provided by the backlight module according to the backlight adjusting coefficient retrieved by the retrieving module.

19 Claims, 3 Drawing Sheets

DISPLAY DEVICE AND BACKLIGHT BRIGHTNESS CONTROL METHOD THEREOF

BACKGROUND

1. Technical Field

The present disclosure relates to an electronic device, and more particularly to a backlight brightness control method used by a display device such as a liquid crystal display.

2. Description of Related Art

Backlight brightness provided by a backlight module of a liquid crystal display (LCD) is often uniform, and does not vary when the scene, displayed by the LCD, changes. In other words, whether the LCD displays a bright or dark scene, the backlight module provides uniform backlight brightness. As such, luminous flux perceived by the human eye is large when a bright scene is displayed, and is low when a dark scene is displayed. Therefore, if the LCD cuts quickly between a bright scene and a dark scene, it could cause eyestrain.

Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout three views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
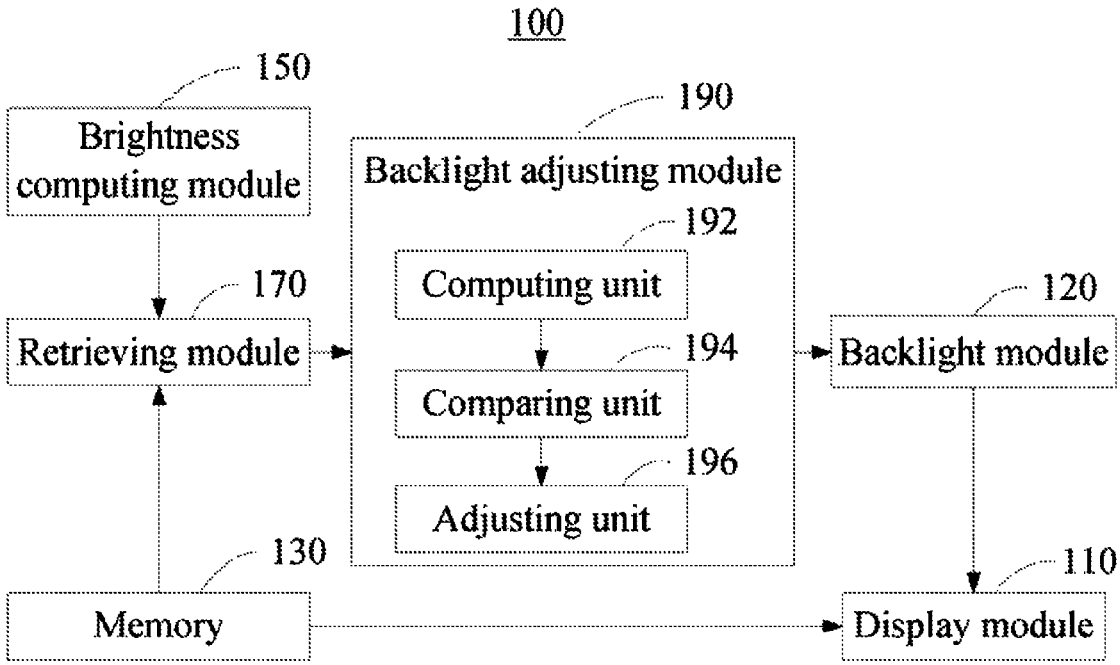
FIG. 1 is a block diagram of a display device in accordance with an embodiment.

Referring to FIG. 1, a display device 100 includes a display module 110 for displaying an image, a backlight module 120, a memory 130, a brightness computing module 150, a retrieving module 170, and a backlight adjusting module 190. In the embodiment, the display device 100 is a liquid crystal display television.

The backlight module 120 is used for providing backlight for the display module 110, thus a user can clearly see the image displayed by the display module 110. The backlight module 120 often has a standard brightness S. In the embodiment, the backlight module 120 is a light-emitting diode (LED) backlight source.

Figure 2:
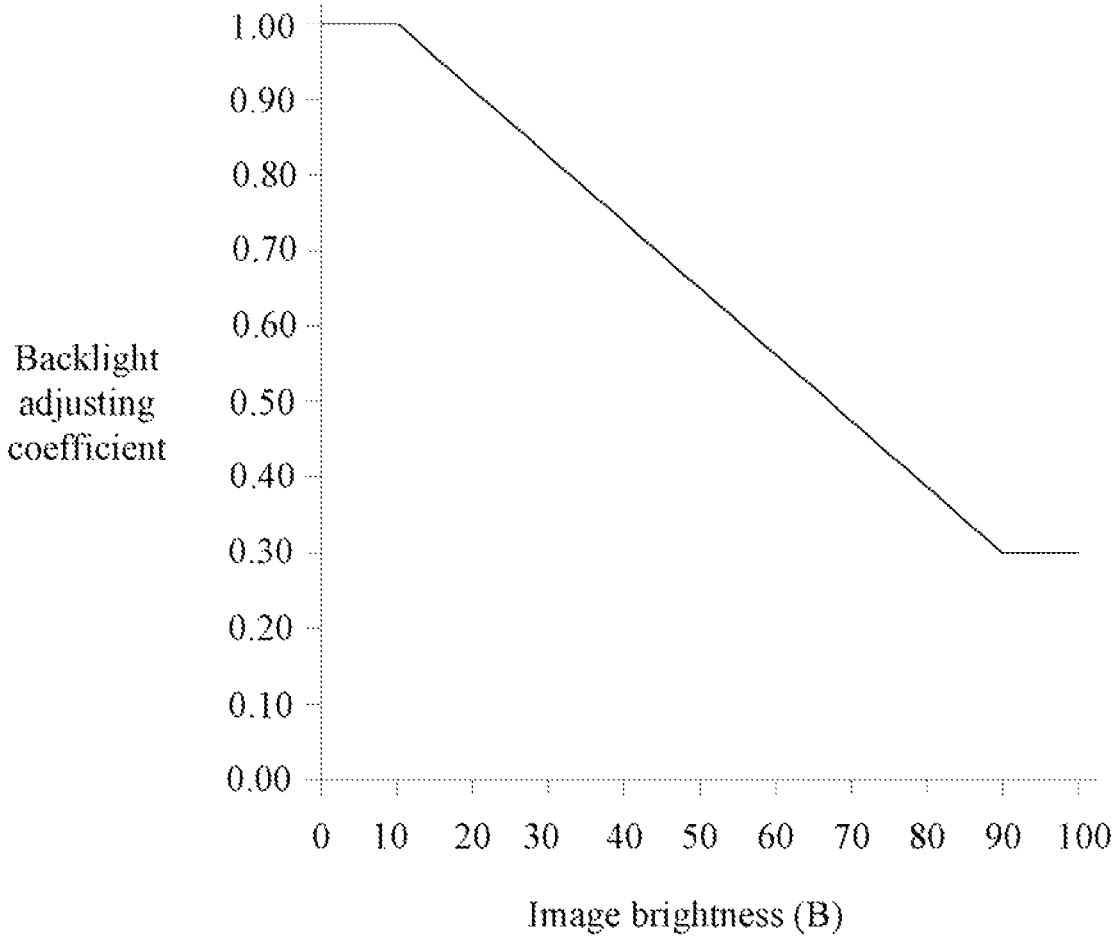
FIG. 2 is a schematic view showing a relationship between image brightness and backlight adjusting coefficient.

The memory 130 is used for storing a relationship between an image brightness B and a backlight adjusting coefficient. Referring also to FIG. 2, the image brightness B can be divided into a number of grades. Each grade corresponds to a backlight adjusting coefficient. In the embodiment, the number of the grades is 100, and the backlight adjusting coefficient is between 0.00 and 1.00.

The brightness computing module 150 is used for computing a current display image brightness B. In the embodiment, an image brightness B is the sum of brightness of all pixels in the image. In other embodiments, the image brightness B also can be the average brightness of all pixels in the image.

The retrieving module 170 is used for retrieving a backlight adjusting coefficient of the current display image from the memory 130 according to the current display image brightness B computed by the brightness computing module 150.

The backlight adjusting module 190 is used for adjusting the backlight brightness provided by the backlight module 120 according to the backlight adjusting coefficient detected by the retrieving module 170. In the embodiment, the backlight adjusting coefficient will decrease with increasing image brightness B; the backlight brightness provided by the backlight module 120 is obtained by multiplying the standard brightness S and the backlight adjusting coefficient. Therefore, the backlight brightness provided by the backlight module 120 will decrease when a bright scene is displayed, and increase when a dark scene is displayed because of the backlight adjusting coefficient. As a result, whether the display module 110 displays a bright scene or a dark scene, the luminous flux perceived by the eye will change very little, thus, it could help reduce eyestrain.

However, when the display module 110 displays two consecutive images which have a large brightness difference, it may cause the displayed image to flicker or the displayed image brightness to dither that the backlight adjusting module 190 adjusts the backlight brightness of the backlight module 120 directly according to the backlight adjusting coefficient detected by the retrieving module 170. For decreasing the flickering of the displayed image and dithering of the displayed image brightness, the backlight adjusting module 190 further needs to adjust the backlight adjusting coefficient detected by the retrieving module 170. Accordingly, the backlight adjusting module 190 further includes a computing unit 192, a comparing unit 194, and an adjusting unit 196.

The computing unit 192 is used for computing a first average A1 of the backlight adjusting coefficients corresponding to a first predetermined number N of images displayed before the current display image. The first predetermined number N can be designed according to requirements of the user.

The comparing unit 194 is used for comparing the backlight adjusting coefficient corresponding to the current display image and the first average A1. If the backlight adjusting coefficient corresponding to the current display image is smaller than the first average A1, and the difference between the backlight adjusting coefficient corresponding to the current display image and the first average A1 is larger than a first predetermined value P1, the displayed image brightness changes from dark to bright and the change of the displayed image brightness is large, thus the pupil of the human eye will contract. Meanwhile, the comparing unit 194 generates a first signal. If the backlight adjusting coefficient corresponding to the current display image is larger than the first average A1, and the difference between the backlight adjusting coefficient corresponding to the current display image and the first average A1 is larger than the first predetermined value P1, the displayed image brightness changes from bright to dark, and the change of the displayed image brightness is large, thus the pupil of the human eye will dilate. Meanwhile, the comparing unit 194 generates a second signal.

The computing unit 192 is used for computing a second average A2 of the backlight adjusting coefficients corresponding to a second predetermined number L of images displayed before the current display image in response to the first signal, and computing a second average A2 of the backlight adjusting coefficients of a third predetermined number M of images displayed before the current display image in response to the second signal. The second predetermined number L is a function of the difference between the first average Al and the backlight adjusting coefficient corresponding to the current display image. The third predetermined number M is a function of the difference between the backlight adjusting coefficient corresponding to the current display image and the first average A1. Because the speed of the pupil of the human eye contracting is quicker than that of the pupil of the human eye dilating, the second predetermined number L is smaller than or equal to the first predetermined number N, and the third predetermined number M is larger than or equal to the first predetermined number N.

The comparing unit 194 is further used for determining whether the difference between the backlight adjusting coefficient corresponding to the current display image and the second average A2 is larger than a second predetermined value P2. If the difference between the backlight adjusting coefficient corresponding to the current display image and the second average A2 is larger than the second predetermined value P2, the change of the displayed image brightness is very large, the adjusting unit 196 directly uses a current backlight adjusting coefficient to adjust the backlight brightness provided by the backlight module 120 to avoid the displayed image from flickering or the displayed image brightness from dithering. Meanwhile, the backlight adjusting coefficients corresponding to the first predetermined number N of images displayed before the current display image are set as the current backlight adjusting coefficient. If the difference between the backlight adjusting coefficient corresponding to the current display image and the second average A2 is smaller than or equal to the second predetermined value P2, the change of the displayed image brightness is small, the adjusting unit 196 replaces the current adjusting coefficient with the second average A2 to adjust the backlight brightness provided by the backlight module 120.

Figure 3:
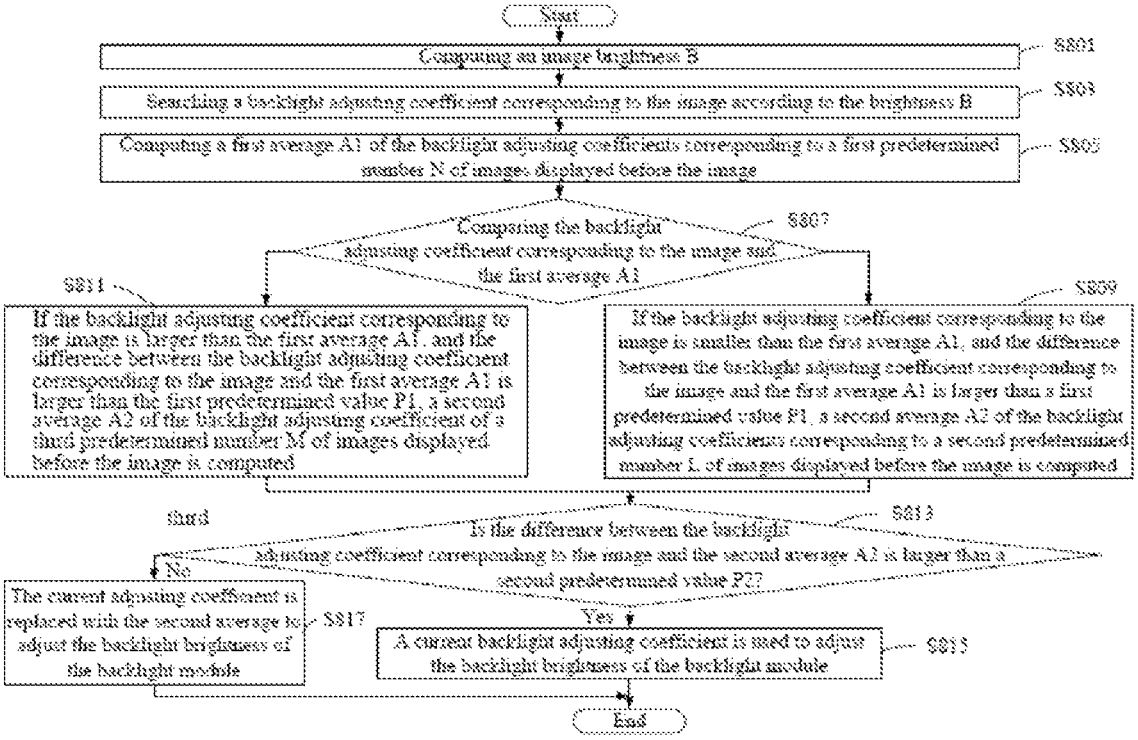
FIG. 3 is a flowchart of a backlight brightness control method in accordance with an embodiment.

Referring to FIG. 3, a backlight brightness control method is used for controlling a backlight brightness provided by a display device according to an image displayed by the display device. The display device includes a display module, a backlight module, and a memory. The display module is used for displaying an image. The backlight module is used for providing backlight for the display module, thus a user can clearly see the image displayed by the display module. The backlight module often has a standard brightness S. The memory is used for storing a relationship between an image brightness B and a backlight adjusting coefficient. Referring also to FIG. 2, the image brightness B can be divided into a number of grades. Each grade corresponds to a backlight adjusting coefficient. In the embodiment, the number of the grades is 100, and the backlight adjusting coefficient is between 0.00 and 1.00.

In step S801, a current display image brightness B is computed. In the embodiment, an image brightness B is the sum of brightness of all pixels in the image. In other embodiments, the image brightness B also can be the average brightness of all pixels in the image.

In step S803, a backlight adjusting coefficient corresponding to the current display image is retrieved from the memory according to the computed image brightness B.

In step S805, a first average A1, of the backlight adjusting coefficients corresponding to a first predetermined number N of images displayed before the current display image, is computed. The first predetermined number N can be designed according to requirements of the user.

In step S807, the backlight adjusting coefficient corresponding to the current display image and the first average A1 is compared. If the backlight adjusting coefficient corresponding to the current display image is smaller than the first average A1, and the difference between the backlight adjusting coefficient corresponding to the current display image and the first average A1 is larger than a first predetermined value P1, the displayed image brightness changes from dark to bright and the change of the displayed image brightness is large, thus the pupil of the human eye will contract. Meanwhile, step S809 is implemented. If the backlight adjusting coefficient corresponding to the current display image is larger than the first average A1, and the difference between the backlight adjusting coefficient corresponding to the current display image and the first average A1 is larger than the first predetermined value P1, the displayed image brightness changes from bright to dark and the change of the displayed image brightness is large, thus the pupil of the human eye will dilate. Meanwhile, step S811 is implemented.

In step S809, a second average A2, of the backlight adjusting coefficients corresponding to a second predetermined number L of images displayed before the current display image, is computed. The second predetermined number L is a function of the difference between the first average A1 and the backlight adjusting coefficient corresponding to the current display image.

In step S811, a second average A2, of the backlight adjusting coefficients of a third predetermined number M of images displayed before the current display image, is computed. The third predetermined number M is a function of the difference between the backlight adjusting coefficient corresponding to the current display image and the first average A1. Because the speed of the pupil of the human eye contracting is quicker than that of the pupil of the human eye dilating, the second predetermined number L is smaller than or equal to the first predetermined number N, and the third predetermined number M is larger than or equal to the first predetermined number N.

In step S813, whether the difference between the backlight adjusting coefficient corresponding to the current display image and the second average A2 is larger than a second predetermined value P2 is determined. If the difference between the backlight adjusting coefficient corresponding to the current display image and the second average A2 is larger than the second predetermined value P2, the change of the displayed image brightness is very large, and then step S815 is implemented. If the difference between the backlight adjusting coefficient corresponding to the current display image and the second average A2 is smaller than or equal to the second predetermined value P2, the change of the displayed image brightness is small, and then step S817 is implemented.

In step S815, a current backlight adjusting coefficient is used to adjust the backlight brightness provided by the backlight module to avoid the displayed image from flickering or the displayed image brightness from dithering. Meanwhile, the backlight adjusting coefficients corresponding to the first predetermined number N of images displayed before the current display image are set as the current backlight adjusting coefficient.

In step S817, the current adjusting coefficient is replaced with the second average A2 to adjust the backlight brightness of the backlight module.

It is to be understood, even though information and advantages of the present embodiments have been set forth in the foregoing description, together with details of the structures and functions of the present embodiments, the disclosure is illustrative only; and that changes may be made in detail, especially in matters of shape, size, and arrangement of parts within the principles of the present embodiments to the full extent indicated by the broad general meaning of the terms in which the appended claims are expressed.

What is claimed is:

1. A display device, comprising:

a display module displaying an image;

a backlight module providing backlight for the display module;

a memory storing a relationship between an image brightness and a backlight adjusting coefficient;

a brightness computing module computing a current display image brightness;

a retrieving module retrieving a backlight adjusting coefficient corresponding to the current display image from the memory according to the current display image brightness computed by the brightness computing module; and a backlight adjusting module adjusting the backlight brightness provided by the backlight module according to the backlight adjusting coefficient retrieved by the retrieving module;

wherein the backlight adjusting module comprises a computing unit, a comparing unit, and an adjusting unit; the computing unit is used for computing a first average of the backlight adjusting coefficients corresponding to a first predetermined number of images displayed before the current display image; the comparing unit is used for comparing the backlight adjusting coefficient corresponding to the current display image and the first average;

if the backlight adjusting coefficient corresponding to the current display image is smaller than the first average, and the difference between the backlight adjusting coefficient corresponding to the current display image and the first average is larger than a first predetermined value, the comparing unit generates a first signal; the computing unit is further used for computing a second average of the backlight adjusting coefficients corresponding to a second predetermined number of images displayed before the current display image in response to the first signal, the comparing unit is further used for determining whether the difference between the backlight adjusting coefficient corresponding to the current display image and the second average is larger than a second predetermined value, and if the difference between the backlight adjusting coefficient corresponding to the current display image and the second average is larger than the second predetermined value, the adjusting unit uses a current backlight adjusting coefficient to adjust the backlight brightness provided by the backlight module.

2. The display device according to claim 1, wherein if the difference between the backlight adjusting coefficient corresponding to the current display image and the second average is smaller than or equal to the second predetermined value, the adjusting unit replaces the current adjusting coefficient with the second average to adjust the backlight brightness provided by the backlight module.

3. The display device according to claim 1, wherein if the difference between the backlight adjusting coefficient corresponding to the current display image and the second average is larger than the second predetermined value, the backlight adjusting coefficients corresponding to the first predetermined number of images displayed before the current display image are set as the current backlight adjusting coefficient.

4. The display device according to claim 1, wherein the second predetermined number is smaller than or equal to the first predetermined number.

5. The display device according to claim 1, wherein if the backlight adjusting coefficient corresponding to the current display image is larger than the first average, and the difference between the backlight adjusting coefficient corresponding to the current display image and the first average is larger than a first predetermined value, the comparing unit generates a second signal; the computing unit is further used for computing a second average of the backlight adjusting coefficients of a third predetermined number of images displayed before the current display image in response to the second signal; the comparing unit is further used for determining whether the difference between the backlight adjusting coefficient corresponding to the current display image and the second average is larger than a second predetermined value, and if the difference between the backlight adjusting coefficient corresponding to the current display image and the second average is larger than the second predetermined value, the adjusting unit uses a current backlight adjusting coefficient to adjust the backlight brightness provided by the backlight module.

6. The display device according to claim 5, wherein if the difference between the backlight adjusting coefficient corresponding to the current display image and the second average is smaller than or equal to the second predetermined value, the adjusting unit replaces the current adjusting coefficient with the second average to adjust the backlight brightness of the backlight module.

7. The display device according to claim 5, wherein if the difference between the backlight adjusting coefficient corresponding to the current display image and the second average is larger than the second predetermined value, the backlight adjusting coefficients corresponding to the first predetermined number of images displayed before the current display image are set as the current backlight adjusting coefficient.

8. The display device according to claim 5, wherein the third predetermined number is larger than or equal to the first predetermined number.

9. A backlight brightness control method, for controlling the backlight brightness provided by a display device according to an image displayed by the display device, the display device comprising a display module for displaying an image, a backlight module, and a memory; the backlight module providing backlight for the display module; the memory storing a relationship between an image brightness and a backlight adjusting coefficient; the backlight brightness control method comprising:

computing a current display image brightness;

retrieving a backlight adjusting coefficient corresponding to the current display image from the memory according to the computed image brightness; and;

computing a first average of the backlight adjusting coefficients corresponding to a first predetermined number of images displayed before the current display image;

comparing the backlight adjusting coefficient corresponding to the current display image and the first average;

if the backlight adjusting coefficient corresponding to the current display image is larger than the first average, and the difference between the backlight adjusting coefficient corresponding to the current display image and the first average is larger than a first predetermined value, computing a second average of the backlight adjusting coefficients corresponding to a third predetermined number of images displayed before the current display image;

determining whether the difference between the backlight adjusting coefficient corresponding to the current display image and the second average is larger than a second predetermined value; and if the difference between the backlight adjusting coefficient corresponding to the current display image and the second average is larger than the second predetermined value, adjusting the backlight brightness of the backlight module based on a current backlight adjusting coefficient.

10. The backlight brightness control method according to claim 9, wherein the step of adjusting the backlight brightness of the backlight module based on the retrieved backlight adjusting coefficient further comprises:

if the backlight adjusting coefficient corresponding to the current display image is smaller than the first average, and the difference between the backlight adjusting coefficient corresponding to the current display image and the first average is larger than a first predetermined value, computing a second average of the backlight adjusting coefficients corresponding to a second predetermined number of images displayed before the current display image;

determining whether the difference between the backlight adjusting coefficient corresponding to the current display image and the second average is larger than a second predetermined value; and if the difference between the backlight adjusting coefficient corresponding to the current display image and the second average is larger than the second predetermined value, adjusting the backlight brightness of the backlight module based on a current backlight adjusting coefficient.

11. The backlight brightness control method according to claim 10, further comprising:

if the difference between the backlight adjusting coefficient corresponding to the current display image and the second average is smaller than or equal to the second predetermined value, replacing the current adjusting coefficient with the second average to adjust the backlight brightness provided by the backlight module.

12. The backlight brightness control method according to claim 9, further comprising:

if the difference between the backlight adjusting coefficient corresponding to the current display image and the second average is smaller than or equal to the second predetermined value, replacing the current adjusting coefficient with the second average to adjust the backlight brightness provided by the backlight module.

13. The backlight brightness control method according to claim 9, wherein the third predetermined number is larger than or equal to the first predetermined number.

14. The backlight brightness control method according to claim 9, wherein third predetermined number is larger than or equal to the first predetermined number.

15. The backlight brightness control method according to claim 9, wherein third predetermined number is a function of the difference between the backlight adjusting coefficient corresponding to the current display image and the first average.

16. The backlight brightness control method according to claim 10, wherein the second predetermined number is smaller than or equal to the first predetermined number.

17. The backlight brightness control method according to claim 10, wherein the second predetermined number is a function of the difference between the first average and the backlight adjusting coefficient corresponding to the current display image.

18. The display device according to claim 1, wherein the second predetermined number is a function of the difference between the first average and the backlight adjusting coefficient corresponding to the current display image.

19. The display device according to claim 5, wherein the third predetermined number is a function of the difference between the backlight adjusting coefficient corresponding to the current display image and the first average.

* * * * *